US011857834B2

(12) United States Patent
Hsu

(10) Patent No.: US 11,857,834 B2
(45) Date of Patent: Jan. 2, 2024

(54) MULTI-DIRECTIONAL WORKOUT WHEEL DEVICE

(71) Applicant: CHIN CHARNG INDUSTRIAL CO., LTD, Tainan (TW)

(72) Inventor: Wen-Chung Hsu, Tainan (TW)

(73) Assignee: CHIN CHARNG INDUSTRIAL CO., LTD, Tainan (TW)

( * ) Notice: Subject to any disclaimer, the term of this patent is extended or adjusted under 35 U.S.C. 154(b) by 179 days.

(21) Appl. No.: 17/677,324

(22) Filed: Feb. 22, 2022

(65) Prior Publication Data

US 2022/0288448 A1 Sep. 15, 2022

(30) Foreign Application Priority Data

Mar. 11, 2021 (TW) ..... 110108800

(51) Int. Cl.

| | |
|---|---|
| ***A63B 23/02*** | (2006.01) |
| ***A63B 21/015*** | (2006.01) |
| ***A63B 22/20*** | (2006.01) |
| ***A63B 21/00*** | (2006.01) |

(52) U.S. Cl.

CPC ..... *A63B 23/0211* (2013.01); *A63B 21/015* (2013.01); *A63B 21/4035* (2015.10); *A63B 22/20* (2013.01); *A63B 2208/0219* (2013.01)

(58) Field of Classification Search

CPC ..... A63B 21/00061; A63B 21/015; A63B 21/4035; A63B 22/20; A63B 23/0211; A63B 2208/0219; A63B 2210/50

See application file for complete search history.

(56) References Cited

U.S. PATENT DOCUMENTS

| | | | | |
|---|---|---|---|---|
| 11,426,624 | B1 * | 8/2022 | Reisinger, Jr. ..... | A63B 21/4035 |
| 2012/0252645 | A1 | 10/2012 | Agostini | |
| 2013/0023391 | A1 * | 1/2013 | Nicholas ..... | A63B 21/0004 482/132 |
| 2015/0024912 | A1 | 1/2015 | Ricciardi | |
| 2017/0296864 | A1 | 10/2017 | Richter | |
| 2020/0376331 | A1 * | 12/2020 | Moridaira ..... | A63B 22/20 |

FOREIGN PATENT DOCUMENTS

| | | |
|---|---|---|
| CN | 205850104 | 1/2017 |

OTHER PUBLICATIONS

Japan Intellectual Property Office, OA dated Apr. 18, 2023.

* cited by examiner

*Primary Examiner* — Joshua Lee
(74) *Attorney, Agent, or Firm* — WPAT, P.C.

(57) ABSTRACT

A workout device includes a base frame, a top cover and a gliding mechanism. The base frame includes a chassis and through holes formed in the chassis. The top cover includes dome structures aligned with the through holes, respectively, when the top cover is assembled to the base frame. The gliding mechanism consists of multi-directional rotating members accommodated in the dome structures and partially protruding from the through holes, respectively, when the top cover is assembled to the base frame. In response to a pressing force exerted onto the cover body, the dome structures are in contact with the multi-directional rotating members so as to cause friction therebetween, and the friction changes with the force exerted onto the cover body.

12 Claims, 12 Drawing Sheets

MULTI-DIRECTIONAL WORKOUT WHEEL DEVICE

FIELD OF THE INVENTION

The present invention relates to a workout wheel device, and more particularly to a multi-directional workout wheel device. The present invention also relates to a workout wheel kit, and more particularly to a workout wheel kit including replaceable parts for friction control.

BACKGROUND OF THE INVENTION

For those who are too busy to go to the gym and have limited living space, small fitness equipment for home use, e.g., treadmills, dumbbells, and exercise bikes, become more and more popular nowadays. A fitness wheel as shown in FIG. 1 is also one of the popular fitness equipment for home use. The fitness wheel includes a wheel body 13 placed on a working plane or slope, and a user can hold the fitness wheel with respective hands at the first grip end 11 and the second grip end 12. When in use, the user in a kneeling or prone position pushes and pulls the fitness wheel forwards and backwards to have the fitness wheel glide back and forth on the working plane or slope. Since the wheel body 13 has a certain coefficient of friction relative to the working plane or slope, the user needs to exert certain levels of forces with certain parts of muscles of his body, e.g., abdominal, waist, hip and arm muscles, so as to enhance muscular endurance. Such a fitness wheel, however, can only glide linearly, and is thus disadvantageous for training diverse muscles. It would be also boring for daily uses.

CN 205850104 discloses a fitness wheel, which provides additional workout programs. In order to glide in multiple directions, the fitness wheel utilizes balls rotatable in multiple directions to move on the working plane or slope. As understood, it is hard for a user in a kneeling or prone position to physically stop rotating balls and draw back the fitness wheel. Therefore, the prior art uses an independent brake mechanism to raise the balls from the working plane or slope, thereby stopping the fitness wheel from gliding on the working plane or slope. The prior art, however, has at least two drawbacks. First of all, the additional brake mechanism makes the assembly complicated and cost-inefficient. In addition, the user needs to have one hand free for operating the brake mechanism while working out.

SUMMARY OF THE INVENTION

Therefore, the present invention provides a multi-directional workout wheel device, which is produced with simple elements and can be started and halted readily.

In an aspect of the present invention, a workout device comprises: a base frame including a chassis and a plurality of through holes formed in the chassis; a top cover including a cover body, in which a plurality of dome structures are included, each of the dome structures being aligned with one of the through holes when the top cover is assembled to the base frame; and a gliding mechanism consisting of a plurality of multi-directional rotating members, each of the multi-directional rotating members being accommodated in one of the dome structures and partially protruding from one of the through holes when the top cover is assembled to the base frame. In response to a pressing force exerted by a user onto the cover body, the dome structures are in contact with the multi-directional rotating members so as to cause a specified level of friction therebetween, and the friction between the dome structures and the multi-directional rotating members change with a magnitude, direction and/or point of the force exerted onto the cover body.

In another aspect of the present invention, a workout wheel kit comprises: a base frame including a chassis and a plurality of through holes formed in the chassis; a first top cover and a second top cover, one of the first and second top covers being detachably assembled to the base frame, and each of the first and second top covers including a cover body, in which a plurality of dome structures are included, wherein each of the dome structures is aligned with one of the through holes when the first or second top cover is assembled to the base frame; and a gliding mechanism consisting of a plurality of multi-directional rotating members, each of the multi-directional rotating members being accommodated in one of the dome structures of the first or second top cover and partially protruding from one of the through holes when the first or second top cover is assembled to the base frame. When a pressing force is exerted onto the cover body of the first top cover to push the dome structures of the first top cover in contact with the multi-directional rotating members, a first level of friction is caused. On the other hand, when the same pressing force is exerted onto the cover body of the second top cover to push the dome structures of the second top cover in contact with the multi-directional rotating members, a second level of friction, which is different from the first level of friction, is caused.

In a further aspect of the present invention, a base frame including a chassis and a plurality of through holes formed in the chassis; a top cover including a cover body, in which a plurality of dome structures are included, each of the dome structures being aligned with one of the through holes when the top cover is assembled to the base frame; and a first gliding mechanism and a second gliding mechanism, one of the first and second gliding mechanisms being detachably installed between the base frame and the top cover, and the first and second gliding mechanisms consisting of a first set of multi-directional rotating members and a second set of multi-directional rotating members, respectively, wherein each of the multi-directional rotating members in the first set or the second set is accommodated in one of the dome structures and partially protruding from one of the through holes when the top cover is assembled to the base frame. In a case that a pressing force is exerted onto the cover body to push the dome structures in contact with the first set of multi-directional rotating members, a first level of friction is caused; and in another case that the same pressing force is exerted onto the cover body to push the dome structures in contact with the second set of multi-directional rotating members, a second level of friction, which is different from the first level of friction, is caused.

BRIEF DESCRIPTION OF THE DRAWINGS

The above contents of the present invention will become more readily apparent to those ordinarily skilled in the art after reviewing the following detailed description and accompanying drawings, in which.

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only; it is not intended to be exhaustive or to be limited to the precise form disclosed.

Figure 1:
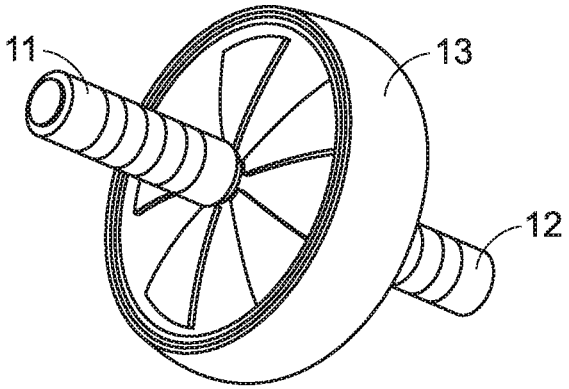
FIG.1 PRIOR ART
FIG. 1 is a schematic diagram illustrating a conventional fitness wheel.
Figure 2A:
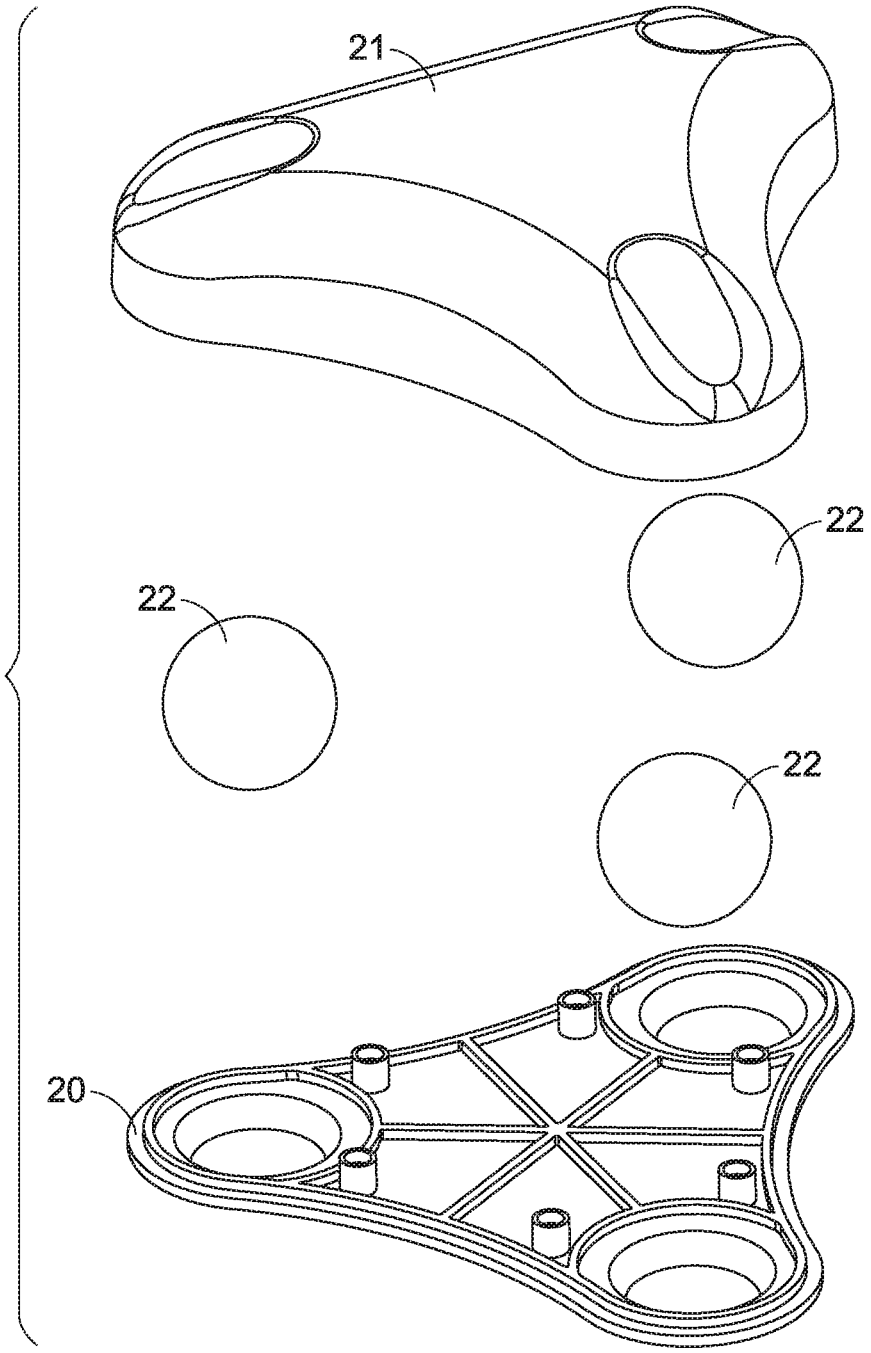
FIG. 2A is parts breakdown illustration of a multi-directional workout wheel device according to an embodiment of the present invention.

FIG. 2A schematically illustrates a multi-directional workout wheel device. The workout wheel device includes a main body consisting of a base frame 20 and a top cover 21, and a gliding mechanism consisting of a plurality of multi-directional rotating members 22. Preferably but unnecessarily, the contour of the top cover 21 conforms to that of the base frame 20, and the main body is symmetrically shaped. Meanwhile, the multi-directional rotating members 22 are disposed between the base frame 20 and the top cover 21 and distributed evenly in order to keep the main body balanced and stable. In this embodiment, a plurality of multi-directional rotating members 22 are installed substantially at corners of the main body. Alternatively, the multi-directional rotating members may be installed at proper positions other than corners. It is also feasible to install a single multi-directional rotating member, for example, at the center of the main body. Under this circumstance, additional elements known to those skilled in the art may be optionally included to balance or stabilize the device. Furthermore, each of the multi-directional rotating members may be implemented with a ball, as shown in FIG. 2A, or a set of balls (not shown). In the embodiment shown in FIG. 2A, the main body is of a triangle-like shape, and three balls are allocated at the three corners of the main body, respectively. It is understood that other rotatable structures may also be used instead of balls to serve as the multi-directional rotating members as long as they are capable of rotating in multiple directions under control of the user.

In this embodiment, the base frame 20, the top cover 21 and the balls 22 may be made of high strength engineering plastics with good mechanical properties. For example, the base frame 20 and the top cover 21 are made of polypropylene (PP), and the relatively smooth balls 22 are made of polyethylene (PE).

Figure 2B:
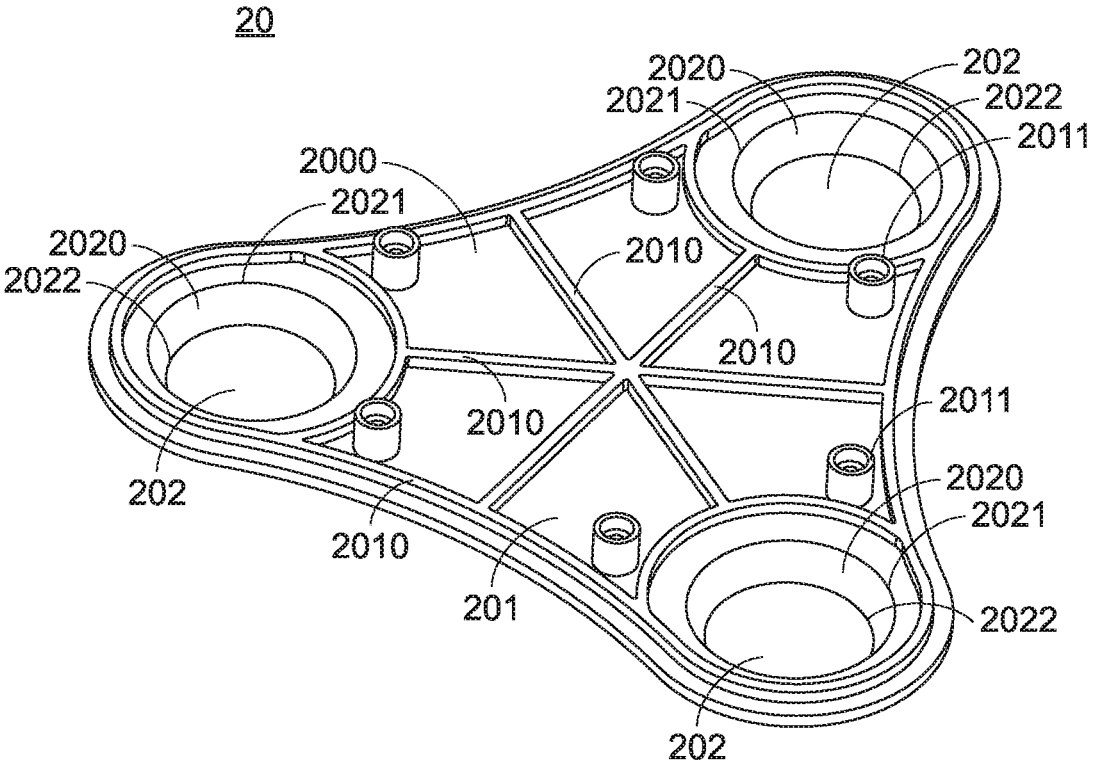
FIG. 2B is a top perspective view of a base frame of the multi-directional workout wheel device shown in FIG. 2A
Figure 2C:
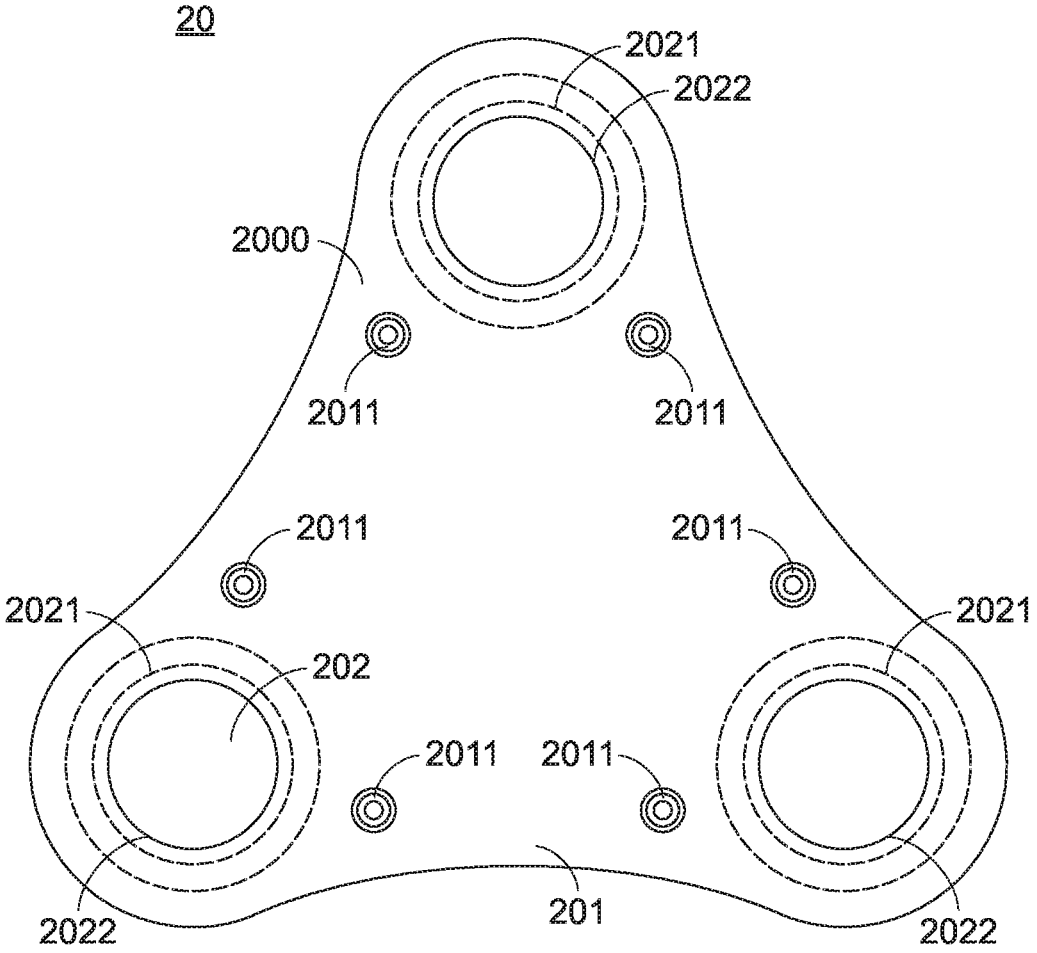
FIG. 2C is a bottom view of a base frame of the multi-directional workout wheel device shown in FIG. 2A.

FIGS. 2B and 2C schematically illustrate the top and the bottom of the base frame 20, respectively. As shown in FIG. 2B, the base frame 20 includes a chassis 201 and three through holes 202 evenly distributed at three corners of the chassis 201 for accommodating three balls 22. The size of each the through hole 202 should be large enough for the ball 22 to freely rotate therein while being small enough to block the ball 22 from escaping therefrom. For example, when the through holes 202 are circular, a diameter of each of the through holes 202 is slightly smaller than a diameter of the corresponding ball 22 accommodated therein. In the specifically exemplified embodiment as shown in FIG. 2A, each of the through holes 202 is confined with a tapered wall 2020. That is, the surrounding wall 2020 is tapered so that the through hole 202 has a larger top opening 2021 and a smaller bottom opening 2022, and the diameter of the bottom opening 2022 is slightly smaller than that of the corresponding ball 22 accommodated therein. In this way, the ball 22 can freely rotate in the through hole 202 without escaping from the base frame 20. In this embodiment, the through holes 202 are shaped as partially cropped and reversed cones. Alternatively, the through holes 202 may be shaped as partially cropped and reversed pyramids such as triangular pyramids, quadrangular pyramids, pentagonal pyramids, hexagonal pyramids, etc.

In the above-described embodiment, it is desirable that the diameter of each of the through holes 202 is slightly smaller than the diameter of the corresponding ball 22 accommodated therein in order to retain the ball 22 in the through hole 202. Nevertheless, it is also feasible to have the diameter of the through hole 202 greater than the diameter of the corresponding ball 22 as long as a confining mechanism is provided in the through hole 202 to retain the ball 22 in the through hole 202. The confining mechanism, for example, may be implemented with several flexible members protruding inwards from the wall of the through hole 202 or an annular brush installed on the wall of the through hole 202. The annular brush is additionally beneficial to sweep the rotating ball 22.

Furthermore, the chassis 201 includes a plurality of supporting ribs 2010, which are integrally formed with a base plate 2000 of the chassis 201 and properly distributed to strengthen the chassis 201. The chassis 201 further includes a plurality of coupling members 2011, which are also integrally formed with the base plate 2000, for combination with corresponding coupling members 2111 of the top cover 21. The coupling members 2011 and 2111, for example, may be threaded holes, which are connected together with screws (not shown).

Figure 2D:
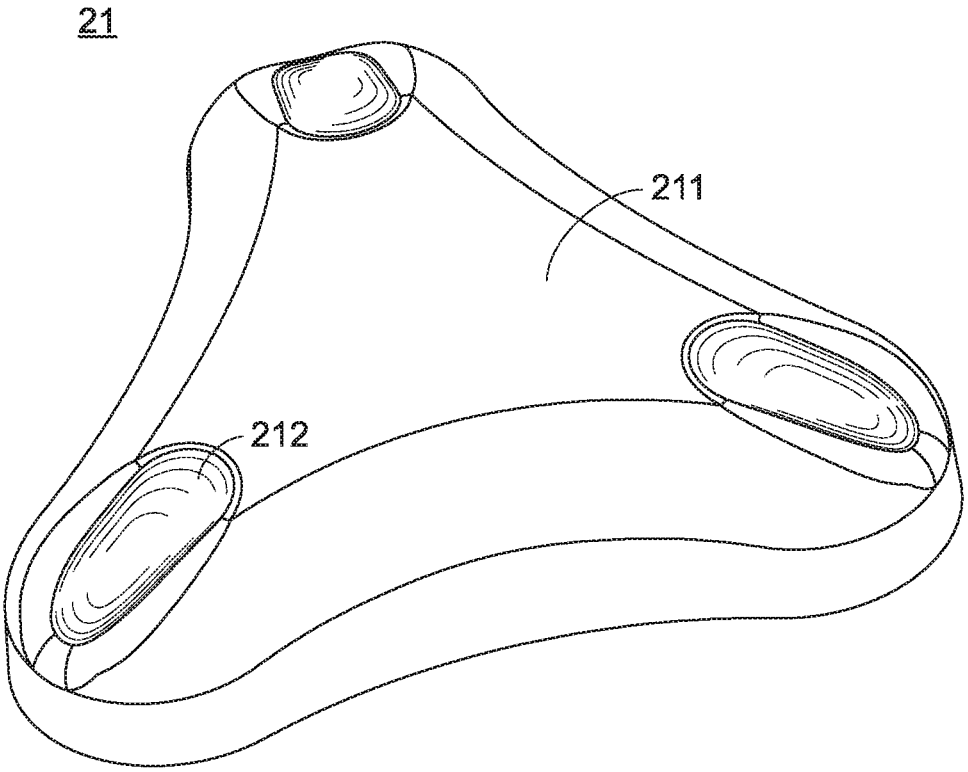
FIG. 2D is a top perspective view of a top cover of the multi-directional workout wheel device shown in FIG. 2A.
Figure 2E:
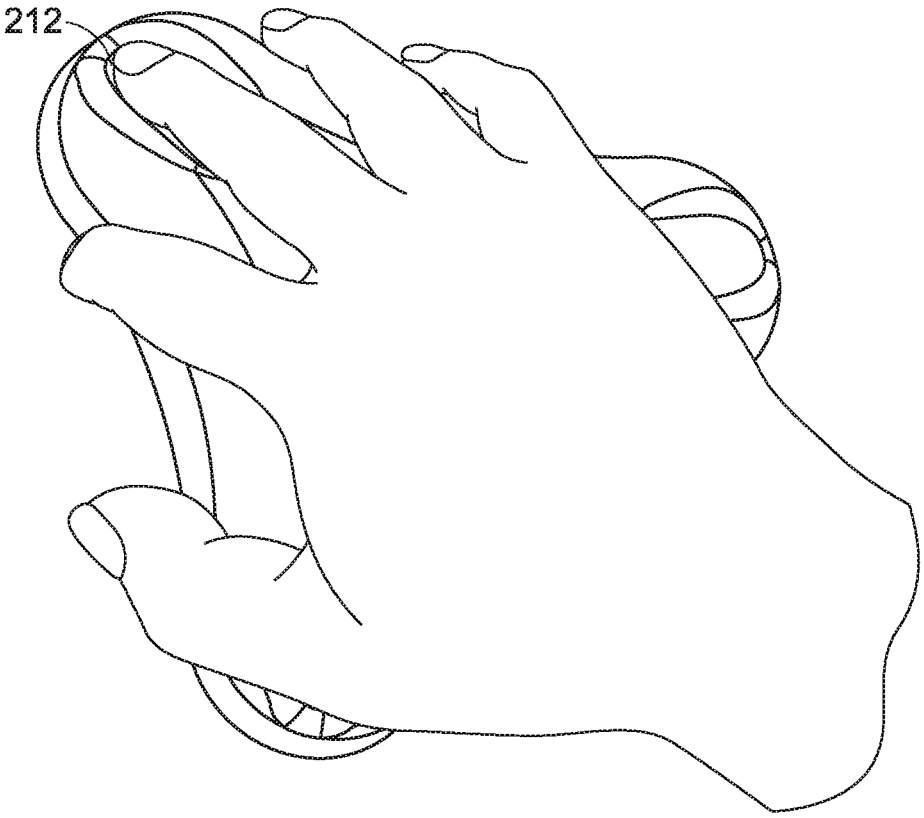
FIG. 2E is a schematic diagram illustrating an operational way of the multi-directional workout wheel device shown in FIG. 2A.
Figure 2F:
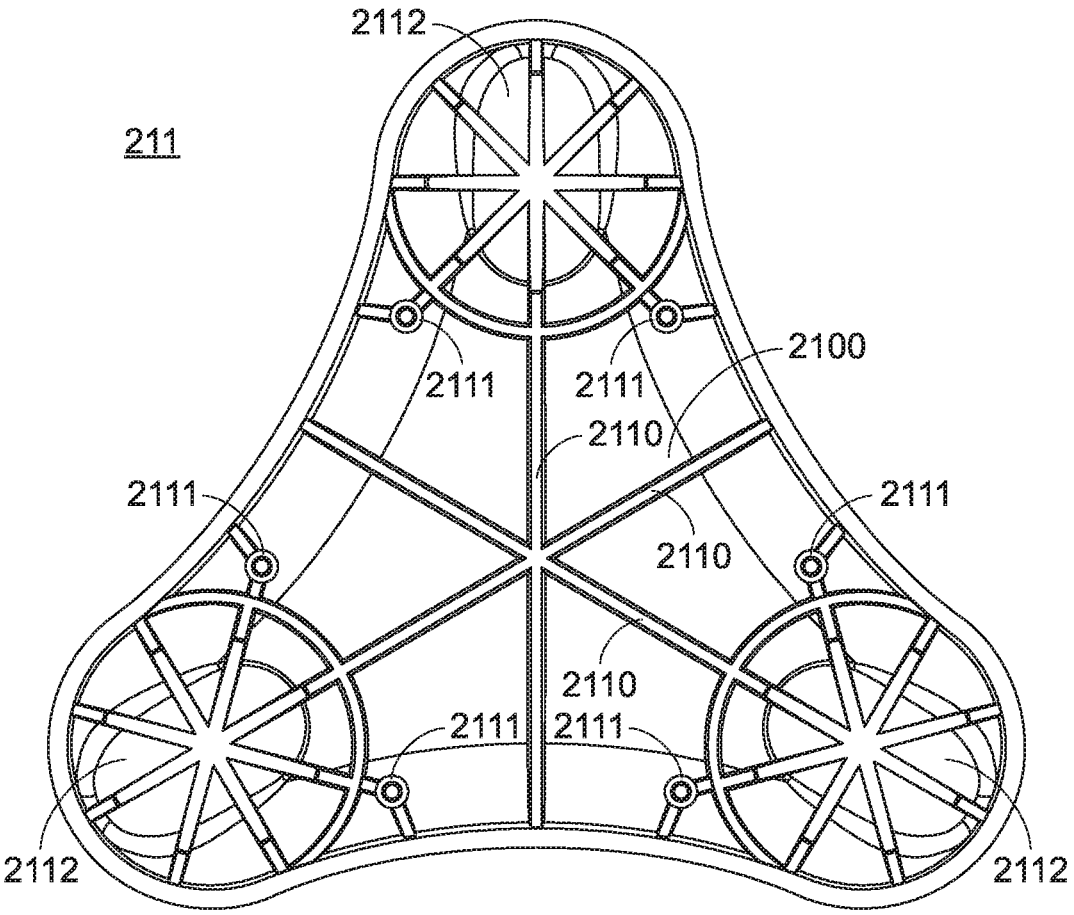
FIG. 2F is a bottom view of a top cover of the multi-directional workout wheel device shown in FIG. 2A.

Please refer to FIGS. 2D, 2E and 2F, which schematically illustrate top and bottom configurations of the top cover 21 assembled to the base frame 20. The top cover 21 includes a cover body 211 and a plurality of recesses 212. The recesses 212 are formed on the cover body 211 at the top side to facilitate enhancement of the flexural strength of the top cover 21. Furthermore, when in use, the user holds the cover body 211 with his palm, and meanwhile, puts his fingers into the recesses 212 (see FIG. 2E), so that the workout wheel device can be firmly grabbed and stably operated. In addition, as shown in FIG. 2F, the cover body 211 includes a plurality of supporting ribs 2110, which are integrally formed with a base plate 2100 of the cover body 211 at the bottom side and properly distributed to strengthen the cover body 211. The cover body 211 further includes the plurality of coupling members 2111 for combination with corresponding coupling members 2011 of the base frame 20, as mentioned above, and three dome structures 2112 aligned with the through holes 202 when the top cover 21 is assembled to the base frame 20. In the space between one of the dome structures 2112 and a corresponding one of the through holes 202, one of the three balls 22 is accommodated and confined.

Figure 3A:
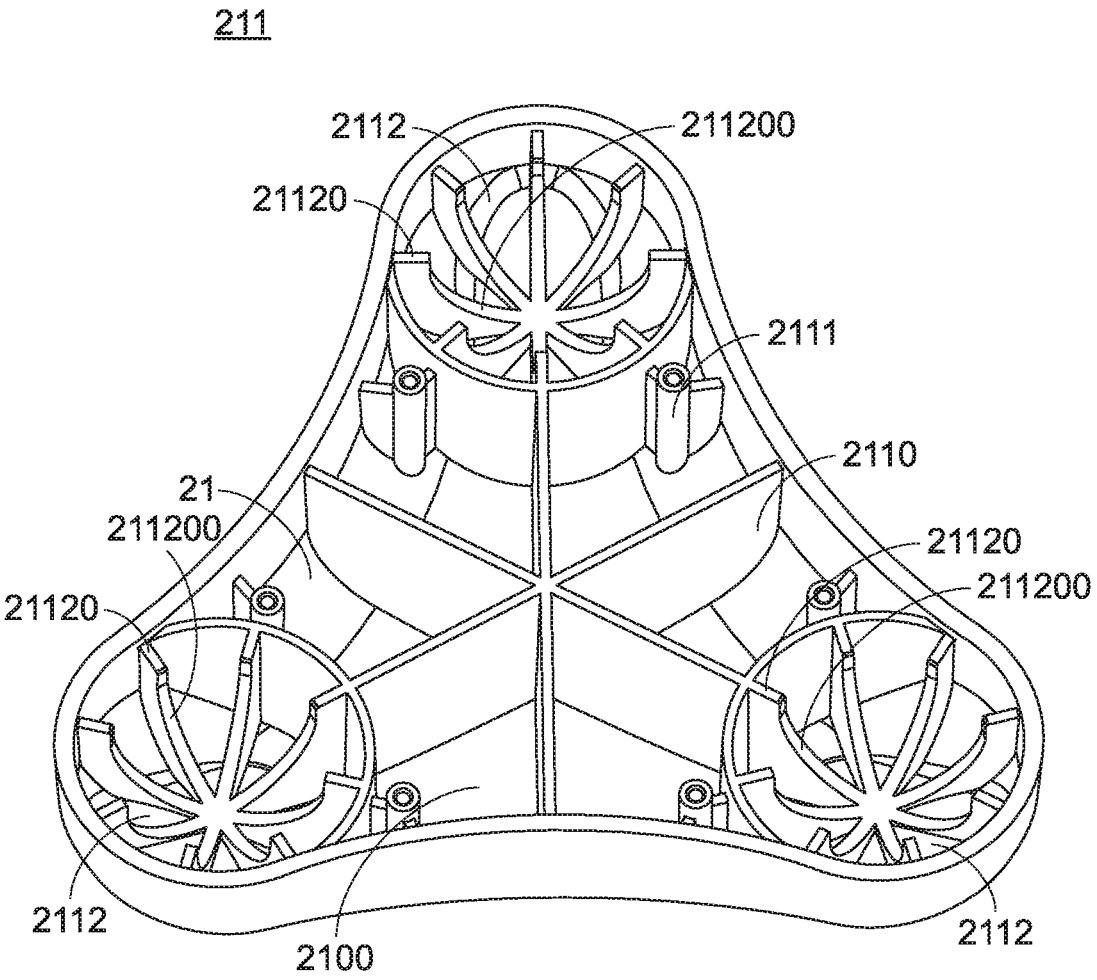
FIG. 3A is a bottom perspective view of a top cover of the multi-directional workout wheel device shown in FIG. 2A.
Figure 3B:
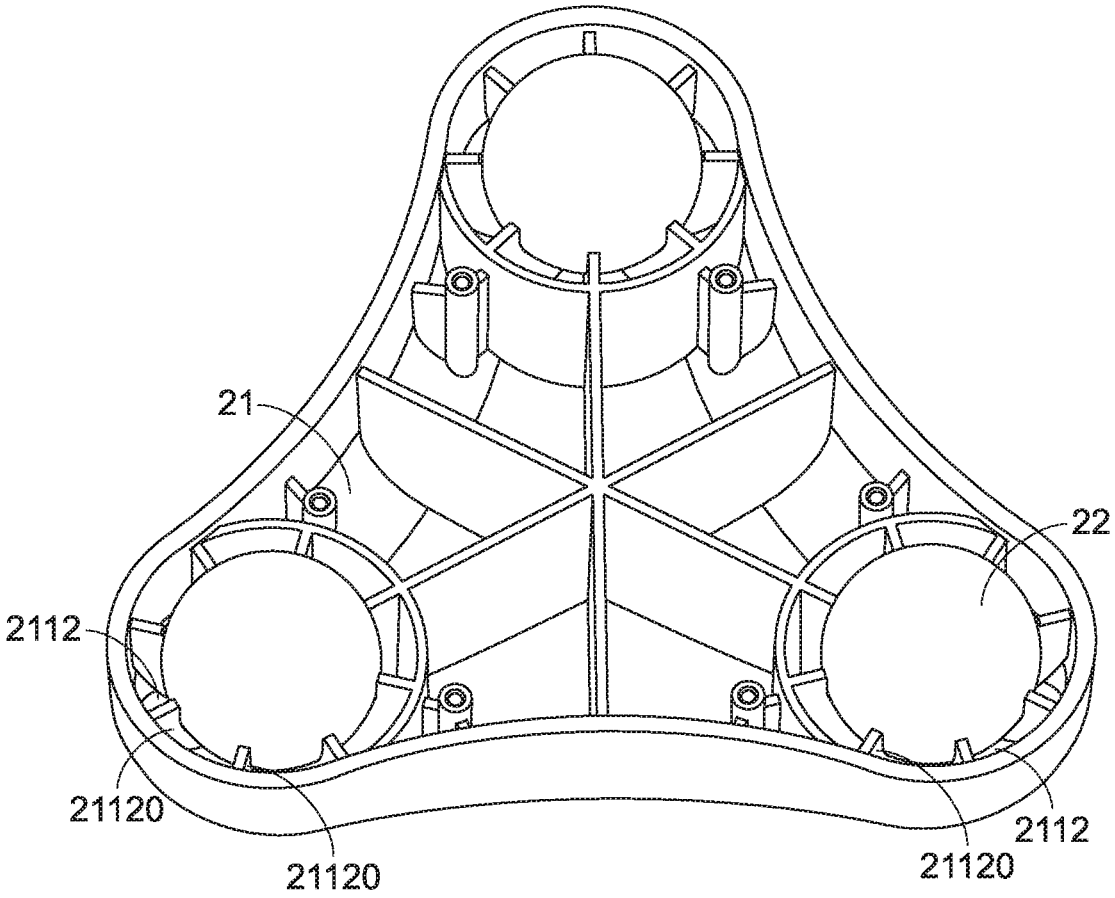
FIG. 3B is a schematic diagram illustrating installation of balls in the top cover shown in FIG. 3A.
Figure 3C:
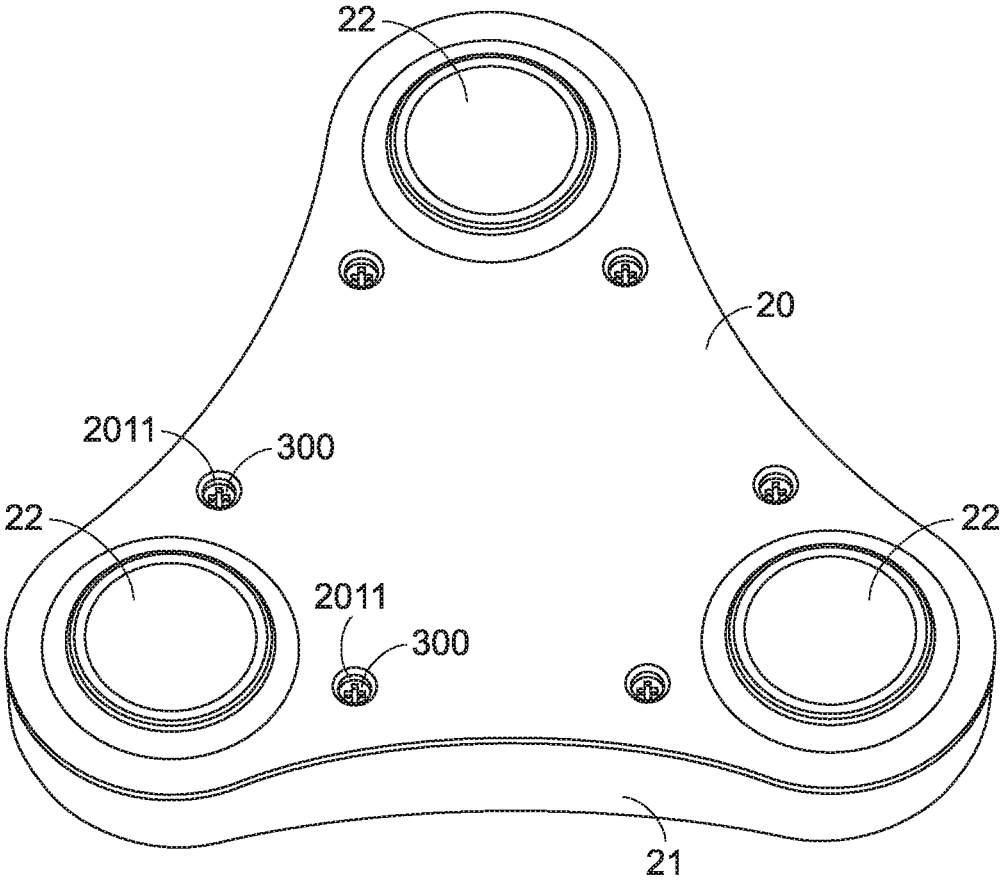
FIG. 3C is a bottom perspective view of the assembled multi-directional workout wheel device shown in FIG. 2A.
Figure 3D:
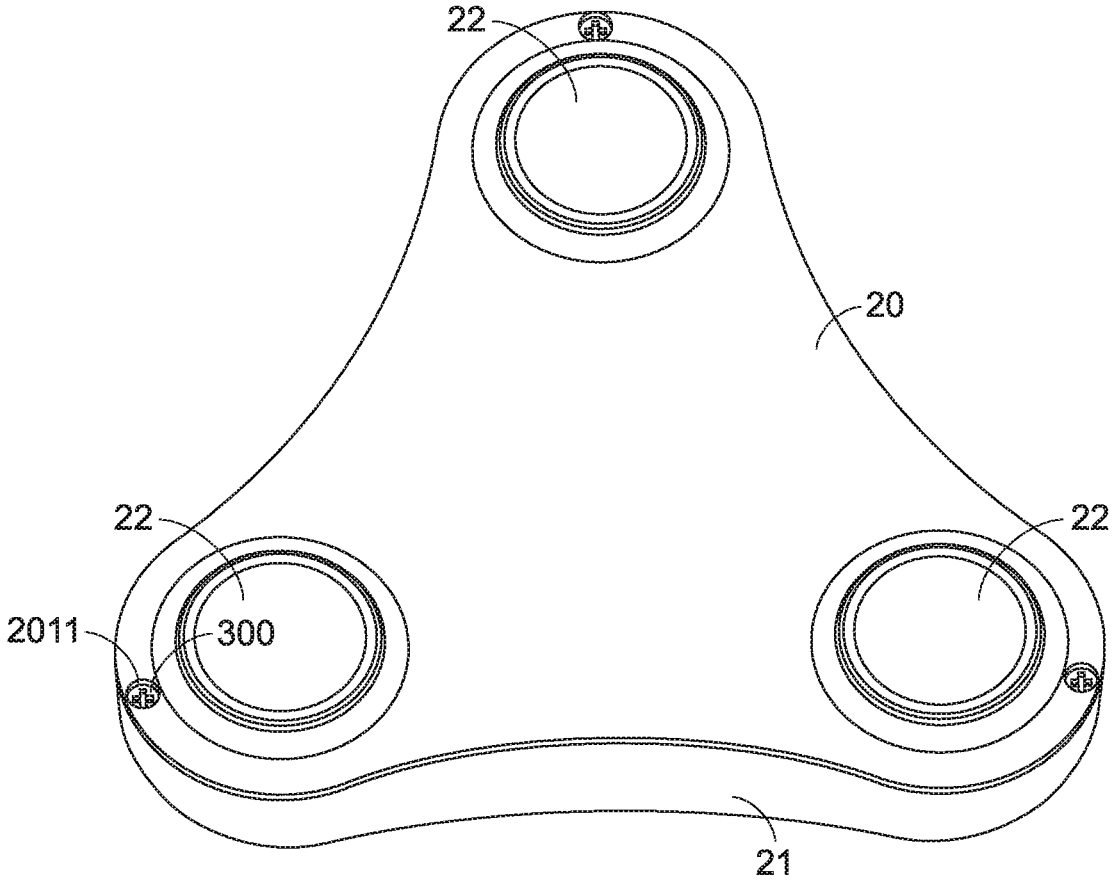
FIG. 3D is a bottom perspective view of a multi-directional workout wheel device according to another embodiment of the present invention.

For clearly showing the dome structures 2112, the base frame 20 is flipped over in FIG. 3A. In this embodiment, each of the dome structures 2112 is implemented with a set of curved ribs 21120, which are also integrally formed with the base plate 2100 at the bottom side, radially extend from a common topmost center, and has a size adapted to receive one of the balls 22 therein, as shown in FIG. 3B. In the operational state, the balls 22 partially protrude from corresponding through holes 202, as shown in FIG. 3C, to be in contact with and rotatable on the working plane or slope. FIG. 3C further illustrates the coupling members 2011 to be combined with the coupling members 2111 by way of screws 300. It is to be noted that the use of screws and threaded holes as the coupling means is an example given for illustration only. Any other suitable coupling means such as bolts or tenons may also be used. Furthermore, the positions and amounts of the coupling members 2011 and 2111 may vary with practical conditions as long as they can be firmly assembled. In the example shown in FIG. 3C, three sets of coupling means, each consisting of two pairs of coupling members 2011 and 2111, are used for assembling the base frame 20 and the top cover 21. Alternatively, FIG. 3D exemplifies a variation of the coupling means, in which three pairs of coupling members 2011 and 2111 are disposed near the three vertices, respectively.

When the workout wheel device is placed onto the working plane or slope, the balls 22 partially drop off from the bottom openings 2022 of the through holes 202. Afterwards, when the user holds the workout wheel device with his palm and pushes the top cover 21 downwards, the bottom surfaces 211200 of the curved ribs 21120 are in contact with the outer surfaces of the balls 22 so as to cause friction between the curved ribs 21120 and the balls 22. The user thus needs to exert a force beyond the frictional force to move the wheel device forwards or backwards, thereby achieving the purpose of exercise. Subsequently, by manually changing the direction and/or magnitude of the force exerted onto the top cover 21 with the user's hand, the level of the friction between the curved ribs 21120 and the balls 22, as well as the balls 22 and the working plane or slope, can be changed. In addition, the frictions occurring at different ball-dome pairs can also be locally adjusted by changing the point of force exerted onto the top cover 21 with the user's hand. For example, by exerting a proper magnitude of backwards and downwards force onto the outmost ball-dome pair, the ball 22 can be stopped from rotation without additional braking means.

For achieving the above-described objects, it is desirable that the workout wheel device is made of a proper material so that the friction between the dome structures and the balls does not hinder the rotation of the balls 22 when the pressing force is substantially evenly exerted onto the three ball-dome pairs. On the other hand, the friction occurring in a specified one of the three ball-dome pairs can be locally increased if the user adjusts the force vector to push harder against the specified ball-dome pair so as to stop the rotation of the corresponding ball 22, and meanwhile, stop the gliding of the entire device.

According to a further aspect of the present invention, a workout wheel kit, which includes a base frame 20, a set of balls 22, and a plurality of replaceable top covers 21, each having a conformable size to the size of the base frame 20, can be provided. The plurality of top covers 21 have similar structures, but the materials, amounts and/or total area of the curved ribs 211200 or the integral top covers 21 are different. Different materials result in different frictions relative to the balls 22. Depending on the required level of friction, a proper one of the top covers 21 is selected to be assembled to the base frame 20. Alternatively, a workout wheel kit, which includes a base frame 20, a top cover 21, and plural sets of balls 22, can be provided according to the present invention. The plural sets of balls are made of different materials so as to have different frictions relative to the curved ribs 211200 of the top cover 21. Depending on the required level of friction, a proper one of the plural sets of balls 22 is selectively used between the base frame 20 and the top cover 21.

Figure 4:
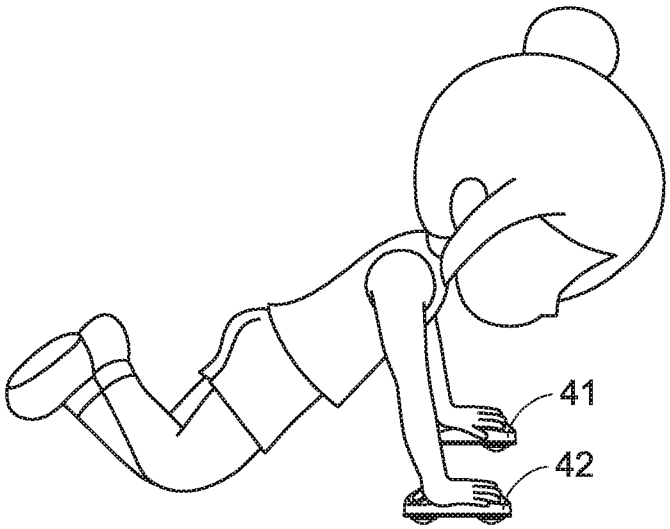
FIG. 4 is a schematic diagram illustrating the use of two workout wheel devices at the same time.
Figure 5:
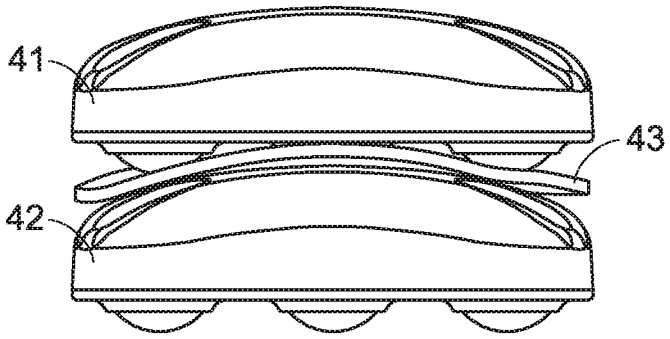
FIG. 5 is a schematic diagram illustrating two workout wheel devices stacked for storage.

Generally, two workout wheel devices 41 and 42 are used at the same time, as shown in FIG. 4. That is, the user stays in kneeling or prone position and holds and manipulates the two workout wheel devices 41 and 42 with his two hands, respectively. Since the workout wheel device according to the present invention can be moved in multiple directions due to the free rotation properties of the balls, diverse body parts or muscles can be selectively trained. By the way, for storage, the two workout wheel devices 41 and 42 can be stacked, as illustrated in FIG. 5, and a soft anti-skid matrix 43 may be placed between the two workout wheel devices 41 and 42 to keep the stack stable.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims which are to be accorded with the broadest interpretation so as to encompass all such modifications and similar structures.

What is claimed is:

1. A workout device, comprising:

a base frame including a chassis and a plurality of through holes formed in the chassis;

a top cover including a cover body, in which a plurality of dome structures are included, each of the dome structures being aligned with one of the through holes when the top cover is assembled to the base frame; and a gliding mechanism consisting of a plurality of multi-directional rotating members, each of the multi-directional rotating members being accommodated in one of the dome structures and partially protruding from one of the through holes when the top cover is assembled to the base frame, wherein in response to a pressing force exerted by a user onto the cover body, the dome structures are in contact with the multi-directional rotating members so as to cause a specified level of friction therebetween, and the friction between the dome structures and the multi-directional rotating members change with a magnitude, direction and/or point of the force exerted onto the cover body.

2. The workout device according to claim 1, wherein each of the dome structures includes a set of curved ribs, which radially extend from a common topmost center, and has a size adapted to receive one of the multi-directional rotating members therein.

3. The workout device according to claim 2, wherein the set of curved ribs are integrally formed with a base plate of the top cover at a bottom side.

4. The workout device according to claim 2, wherein each of the plurality of multi-directional rotating members includes at least a ball.

5. The workout device according to claim 4, wherein each of the plurality of through holes is confined within a tapered wall so as to have a larger top opening and a smaller bottom opening, and a diameter of the bottom opening is slightly smaller than that of the ball accommodated therein to enable the ball to freely rotate in the through hole without escaping from the base frame.

6. The workout device according to claim 1, wherein the top cover further includes a plurality of recesses formed on the cover body at a top side provided for a user to rest his fingers in order to firmly grab and stably operate the workout device.

7. The workout device according to claim 6, wherein each of the plurality of recesses is aligned with one of the multi-directional rotating members when the top cover is assembled to the base frame.

8. The workout device according to claim 7, wherein the cover body is substantially triangle-shaped, and the plurality of recesses are distributed at three corners of the cover body.

9. The workout device according to claim 1, wherein the chassis includes a plurality of supporting ribs, which are integrally formed with a base plate of the chassis and distributed to strengthen the chassis.

10. The workout device according to claim 1, wherein the cover body includes a plurality of supporting ribs, which are integrally formed with a base plate of the cover body at a bottom side, and distributed to strengthen the cover body.

11. A workout wheel kit, comprising:

a base frame including a chassis and a plurality of through holes formed in the chassis;

a first top cover and a second top cover, one of the first and second top covers being detachably assembled to the base frame, and each of the first and second top covers including a cover body, in which a plurality of dome structures are included, wherein each of the dome structures is aligned with one of the through holes when the first or second top cover is assembled to the base frame; and a gliding mechanism consisting of a plurality of multi-directional rotating members, each of the multi-directional rotating members being accommodated in one of the dome structures of the first or second top cover and partially protruding from one of the through holes when the first or second top cover is assembled to the base frame, wherein when a pressing force is exerted onto the cover body of the first top cover to push the dome structures of the first top cover in contact with the multi-directional rotating members, a first level of friction is caused; and when the same pressing force is exerted onto the cover body of the second top cover to push the dome structures of the second top cover in contact with the multi-directional rotating members, a second level of friction, which is different from the first level of friction, is caused.

12. A workout wheel kit, comprising:

a base frame including a chassis and a plurality of through holes formed in the chassis;

a top cover including a cover body, in which a plurality of dome structures are included, each of the dome structures being aligned with one of the through holes when the top cover is assembled to the base frame; and a first gliding mechanism and a second gliding mechanism, one of the first and second gliding mechanisms being detachably installed between the base frame and the top cover, and the first and second gliding mechanisms consisting of a first set of multi-directional rotating members and a second set of multi-directional rotating members, respectively, wherein each of the multi-directional rotating members in the first set or the second set is accommodated in one of the dome structures and partially protruding from one of the through holes when the top cover is assembled to the base frame, wherein in a case that a pressing force is exerted onto the cover body to push the dome structures in contact with the first set of multi-directional rotating members, a first level of friction is caused; and in another case that the same pressing force is exerted onto the cover body to push the dome structures in contact with the second set of multi-directional rotating members, a second level of friction, which is different from the first level of friction, is caused.

* * * * *